US006948921B1

(12) United States Patent
Hölzer et al.

(10) Patent No.: US 6,948,921 B1
(45) Date of Patent: Sep. 27, 2005

(54) VACUUM PUMP COMPRISING AN OUTLET

(75) Inventors: Rainer Hölzer, Hürth (DE); Hermann Boy, Kerpen (DE)

(73) Assignee: Leybold Vakuum GmbH, Cologne (DE)

( * ) Notice: Subject to any disclaimer, the term of this patent is extended or adjusted under 35 U.S.C. 154(b) by 218 days.

(21) Appl. No.: 10/130,638

(22) PCT Filed: Aug. 23, 2000

(86) PCT No.: PCT/EP00/08200

§ 371 (c)(1),
(2), (4) Date: May 20, 2002

(87) PCT Pub. No.: WO01/38742

PCT Pub. Date: May 31, 2001

(30) Foreign Application Priority Data

Nov. 26, 1999 (DE) ..... 299 20 737 U

(51) Int. Cl.[7] ..... F04B 39/00
(52) U.S. Cl. ..... 417/572; 417/454; 417/423.4; 417/440.3; 138/118
(58) Field of Search ..... 417/572, 454, 417/423.4, 410.3; 138/118

(56) References Cited

U.S. PATENT DOCUMENTS 2,263,293 A * 11/1941 Ewald ..... 251/149.6
3,112,012 A * 11/1963 Hoch ..... 417/410.3
3,469,599 A * 9/1969 Kish ..... 417/572
4,621,842 A 11/1986 Kowal et al.
4,685,706 A 8/1987 Kowal et al.
4,917,407 A 4/1990 Gassmann et al.
5,205,568 A 4/1993 Stoll et al. ..... 285/104
5,326,072 A * 7/1994 Wuthrich ..... 251/149.2
5,795,328 A * 8/1998 Barnitz et al. ..... 417/28
6,099,270 A * 8/2000 Wech ..... 417/401

FOREIGN PATENT DOCUMENTS

DE 2416808 A1 10/1975
DE 3143041 C2 5/1983
DE 2937443 A1 12/1987
DE 3710782 A1 10/1988
DE 9316834 U1 1/1994
DE 4444582 A1 6/1996
DE 29613207 U1 10/1996
DE 19755429 A1 6/1999
DE 10237166 A1 * 3/2003 ..... 417/572
JP 56-132483 A * 10/1981 ..... 417/572

* cited by examiner

*Primary Examiner*—Cheryl J. Tyler
*Assistant Examiner*—Emmanuel Sayoc
(74) *Attorney, Agent, or Firm*—Fay, Sharpe, Fagan, Minnich & McKee, LLP

(57) ABSTRACT

A vacuum pump (1, 30) has an inlet (5) and an outlet (6). Plug-in screw fittings (9) are connected with the inlet and the outlet. The plug-in screw fittings include a bore with an internal bevel (22) that receives a flexible connecting line (23), a chuck collet (19), and an O-ring (21) frictionally in a vacuum-tight relationship. In this manner, a more simple and versatile connection is provided between the vacuum pump and the connecting lines.

10 Claims, 1 Drawing Sheet

VACUUM PUMP COMPRISING AN OUTLET

BACKGROUND OF THE INVENTION

The present invention relates to a vacuum pump which comprises an inlet and an outlet, which are equipped with connecting devices for connecting lines.

Inasmuch as not high-vacuum pumps are affected which commonly are firmly joined by a pair of flanges having relatively large diameters to the chamber which is to be evacuated, the connection of the device which is to be evacuated to the inlet of a vacuum pump is provided by means of flexible lines which are connected releasably to the inlet of the vacuum pump. Also the outlet of a vacuum pump must generally be connectable to connecting lines, be it to discharge the pumped gases (in particular when these are aggressive or toxic) in a well controlled manner or in order to be able to connect the vacuum pump, in the instance of a high-vacuum pump, to a backing pump. In all instances, the connection for the connecting lines to the inlet or the outlet of the vacuum pump must be as leak-tight as possible so as to avoid the entry of leakage air or the ejection of detrimental gases.

It is known to employ, for the purpose of attaining a vacuum-tight connection of vacuum pumps with feed or passage lines, flange components (DE-A-24 16 808). At the location where the channel in the vacuum pump opens out at the surface of the casing there is commonly provided a connecting port with a flange. Also the line which needs to be connected the connecting port is equipped with a flange. The connection is provided in that the two flanges are placed on each other and arrested in this position with the aid of a clamping ring or other flange connecting components. Generally in the instance of this type of vacuum-tight connection, sealing rings of plastic, of rubber or also of metal are provided. These are located between the sealing faces in each case. With the aid of grooves, centering rings or alike they are maintained in their nominal position.

The risk of damaging the sealing faces at the protruding flanges is high. This also applies to the required space necessary to provide the flange connection, since both hands are needed to fit and affix a clamping ring or other flange connecting components.

It is the task of the present invention to render the geometrical arrangement of the leak-tight connection between a vacuum pump and a connecting line more user-friendly and more flexible.

SUMMARY OF THE INVENTION

This task is solve through the present invention by the characteristic features of the patent claims.

Plug-in screw fittings have previously only been employed in the area of compressed air engineering. Surprisingly, they have proven themselves to be also vacuum-tight. They consist of a section which can be screwed into the casing of the vacuum pump, and an approximately pot-shaped section permitting a leak-tight, releaseable connection of the vacuum pump to the unoccupied end of a plastic pipe or hose. The pipe is inserted using only one hand into the pot-shaped section until it passes an O-ring located within the component and until it reaches a mechanical stop. Part of the pot-shaped section is a sleeve-shaped collect chuck affecting the circumference of the plastic pipe, said collet chuck being releasable through an axially directed movement.

Plug-in screw fittings of this kind are also available on the market in angled versions and versions for swivelling, and with many diameters. It is important that the connecting lines be made of a flexible material (for example, plastics like polyamide, polyurethane etc. or rubber).

One advantage of the present invention is that it provides for simple and versatile interconnections with ports of a vacuum pump.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
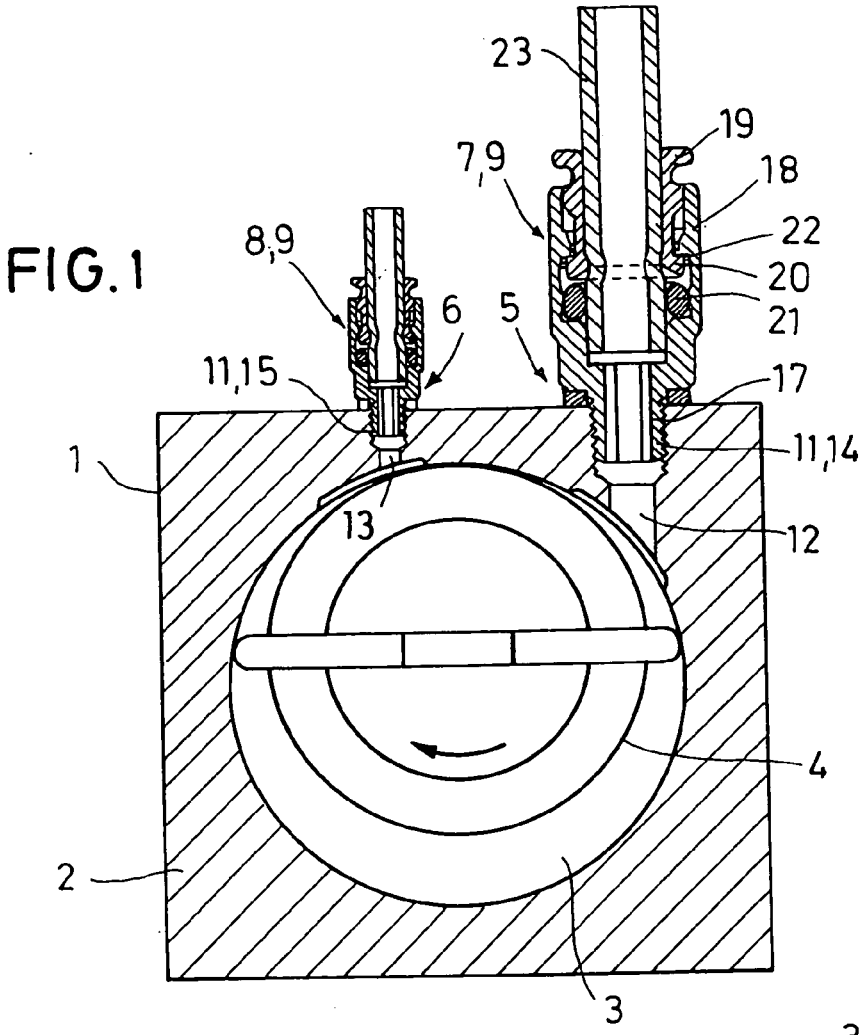
FIG. 1 is a sectional view through a backing pump (rotary vane) in combination with fluid connections in accordance with the present invention; and, FIG. 2 is a partial sectional view through a high-vacuum pump (turbomolecular pump) in combination with an outlet connection in accordance with the present invention.

The cross section of the inlet channel 12 is greater than the cross section of the outlet channel 13. This equally applies to the cross sections of the related plug-in screw fittings 9.

The plug-in screw fittings 9 comprise section 17 which is screwable into casing 2, and an approximately pot-shaped section 18 located outside of the casing 2, said pot-shaped section accommodating the axially movable collet chucks 19 and an O-ring 21. The collet chuck 19 consists of a sleeve slotted on the side of the O-ring and with a bead 20 facing the O-ring, where to said bead a bevel 22 is assigned on the inside of the pot-shaped section 18. Bevel 22 is so designed that it effects the clamping of a line 23 inserted into the sleeve if a pulling force is exerted on it. The clamp is released by moving the collect chuck 19 axially in the direction of the O-ring 21.

Figure 2:
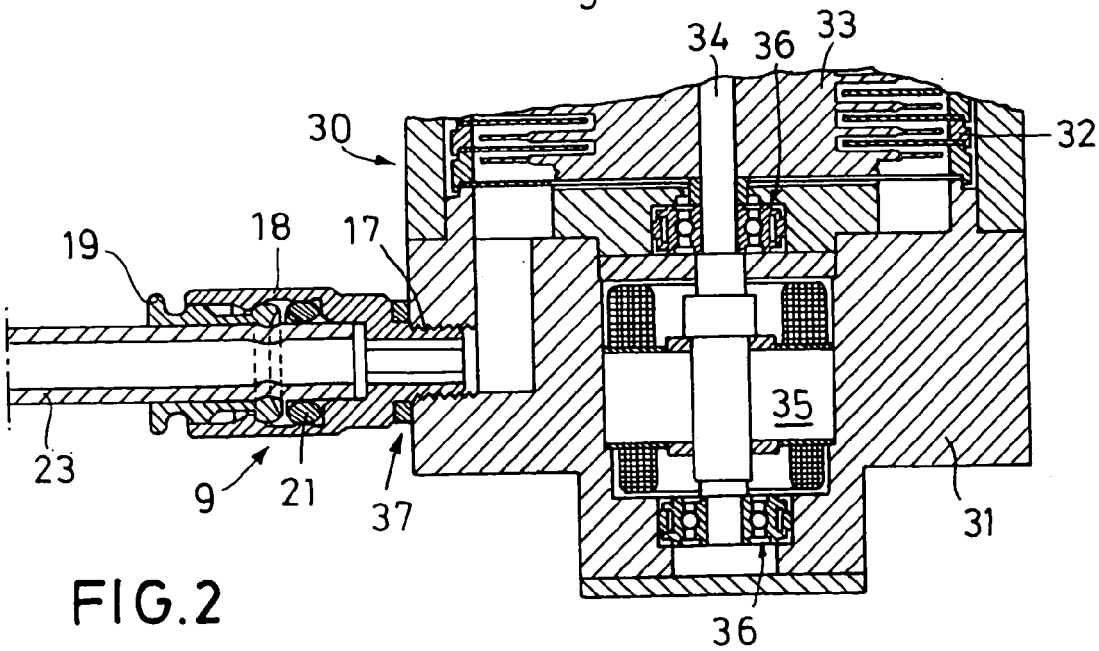

As an example for a high-vacuum pump, a turbomolecular pump 30 is partially depicted in drawing FIG. 2. Its casing is designated as 31, the stator pack located within as 32, the rotor as 33, the rotor shaft as 34 and the driving motor as 35. The shaft 31 is supported by the bearings 36 in casing 31.

As the connection device for the outlet 37 of the turbomolecular pump 30, a plug-in screw fitting 9 is provided as detailed in connection with drawing FIG. 1. Its section 17 is screwed into the outlet channel 38 in casing 31 of the pump 30. The pot-shaped section 18 accepts, among other things, the line 23.

The plug-in screw fitting 9 detailed has proven to be vacuum-tight under the provision that the flexible material of line 23 is capable of sustaining temperatures up to 80° C. Moreover, its surface roughness must be selectable in such a manner that the line 23 is capable of providing, with an O-ring 21 commonly employed in vacuum engineering, a vacuum-tight separation. This is the case in the instance of a roughness of below or equal to $R_z$ 16, preferably $R_z$ 10. Surfaces of $R_z$ 4 to $R_z$ 16 should also be free of transverse striations.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A vacuum pump including an inlet and an outlet which are equipped with connecting devices for connecting lines, at least one of the connecting lines being constructed of a material which is suited for operating temperatures up to 80° C. and has an exterior surface roughness below or equal to RZ 16 and at least the connection device of the outlet of the vacuum pump being a plug-in screw fitting.

2. The pump according to claim 1 wherein the connecting line has an exterior surface roughness of below RZ 10 and is free of transverse striations.

3. A vacuum pump including an inlet and an outlet which are equipped with connecting devices for connecting lines, the line for the outlet connecting device being flexible and frictionally received in a collet having a slotted bead, the outlet connecting device including:

a pot-shaped section having a bore and an inward projecting bevel which engages the bead of the collet to exert a clamping force on the connecting line in response to an axial pulling force on the connecting line;

an O-ring disposed around the connecting line in the bore of the pot-shaped section.

4. The pump according to claim 3, wherein the outlet fitting is a plug-in screw fitting with a threaded section screwed into a casing of the vacuum pump.

5. The pump according to claim 3 wherein the pump is a backing pump.

6. The pump according to claim 3 wherein the pump is a high-vacuum pump.

7. The pump according to claim 3 wherein the outlet connecting line has an exterior surface roughness between RZ 4 and RZ 16 and is free of transverse striations.

8. The pump according to claim 3 wherein the inlet connecting line is flexible and is frictionally received in a collet having a slotted bead and wherein the inlet connecting device includes:

a pot-shaped section having a bore and a projecting bevel which engages the bead of the collet to exert a clamping force on the connecting line in response to an axial force on the connecting line;

an O-ring disposed around the connecting line in the bore of the pot-shaped section.

9. A high vacuum pump including an inlet and an outlet which are equipped with connecting devices for connecting lines, the connection device for the outlet being a plug-in screw fitting and further including:

a casing in which the inlet and the outlet are defined, the casing further defining a pumping chamber;

a rotor rotatably mounted in the pumping chamber of the casing;

interacting vanes mounted on the rotor and the casing in the pumping chamber to define a turbomolecular pumping stage.

10. The pump according to claim 9 wherein the plug-in screw fitting includes:

a pot-shaped section having a bore and a radially inward projecting bevel which engages a bead of a collet on one of the connecting lines to exert a clamping force on the connecting line in response to an axial pulling force on the connecting line;

an O-ring disposed around the connecting line in the bore of the pot-shaped section.

* * * * *